United States Patent [19]

Haulotte

[11] 4,343,379

[45] Aug. 10, 1982

[54] PLATFORM LIFT MECHANISM

[75] Inventor: Georges Haulotte, La Ravoire, France

[73] Assignee: Creusot-Loire, Paris, France

[21] Appl. No.: 151,749

[22] Filed: May 20, 1980

[30] Foreign Application Priority Data

May 22, 1979 [FR] France ..... 79 13909

[51] Int. Cl.[3] ..... B66B 11/04

[52] U.S. Cl. ..... 187/18; 187/8.71; 254/122; 182/141

[58] Field of Search ..... 187/8.71, 8.72, 18; 254/122; 182/63, 69, 144, 157, 158, 141; 92/51-53; 91/176, 183, 168, 169; 248/421, 588, 567; 414/589

[56] References Cited

U.S. PATENT DOCUMENTS 2,984,072 5/1961 Born ..... 91/176
3,820,631 6/1974 King et al. ..... 182/141
3,880,259 4/1975 Richards ..... 187/18

FOREIGN PATENT DOCUMENTS 1080750 4/1960 Fed. Rep. of Germany ..... 254/122
189999 3/1967 U.S.S.R. ..... 187/18

*Primary Examiner*—Joseph J. Rolla
*Assistant Examiner*—Kenneth Noland
*Attorney, Agent, or Firm*—Pollock, Vande Sande & Priddy

[57] ABSTRACT

A mechanism for lifting a platform while maintaining it substantially parallel to a mobile support member, and for simultaneously moving it horizontally with respect to the support member. The mechanism includes scissor elements each having limbs comprising three nesting telescopic elements. The largest diameter element of each set is attached to the support member, while the medial elements of the several sets are connected with each other. The limbs are separately adjustable, so that the platform is movable along selectable vectors.

2 Claims, 3 Drawing Figures

PLATFORM LIFT MECHANISM

BACKGROUND OF THE INVENTION

The present invention concerns movable or fixed apparatuses for raising objects or people vertically, and in particular movable devices used at airports for giving access to airplanes for loading or unloading, the apparatus of the invention being of the type using two support arms articulated together in the form of scissors.

Prior art apparatuses of this type are constituted by a platform or a cabin connected to a chassis which is generally movable, and raisable with respect to the latter by means of support arms articulated together to constitute Nuremberg scissors, and opening out under the action of hydraulic actuators. In this way, the platform or the cabin can be raised to a certain height while remaining parallel to itself during raising.

These known devices present some disadvantages, including the following:

(1) The connections of the support arms to the chassis and the platform are complex, one of the points of support having to be displaced with respect to these during raising, because the limbs of the Nuremberg scissors system are of fixed length.

(2) When the elevation is such that it necessitates several pairs of superposed scissors, the resulting multiplication of articulations involves multiplied working clearances and is very complex to achieve.

(3) With such devices, it is impossible to obtain a translatory movement of the cabin or platform without moving the carrier chassis.

SUMMARY OF THE INVENTION

The elevator device according to the invention does not have the disadvantages of currently known scissors elevator devices. In fact, it makes it possible to obtain considerable heights of elevation without using several pairs of scissors and also to obtain translatory movements without displacement of the carrier chassis. Moreover, in the device according to the invention, all the ends of the scissors are connected to the carrier chassis and the platform, cabin, or other elevating member by articulations at fixed positions. The elevator according to the invention is characterised by the fact that it uses a pair of scissors, each limb of which is constituted by three telescopic elements sliding one within the other so as to extend simultaneously and by the same length, the medial elements of each of the said telescopic limbs being connected together by an articulation located at the intersection of the planes passing through the axes connecting the ends of each of the said limbs respectively to the carrier chassis on the one hand and to the elevating member on the other.

DESCRIPTION OF THE DRAWINGS

The invention will be explained in more detail by means of the following description of an embodiment of a scissors elevator-platform, according to the invention, with reference to the attached drawings in which.

DESCRIPTION OF THE PREFERRED EMBODIMENTS

Figure 1:
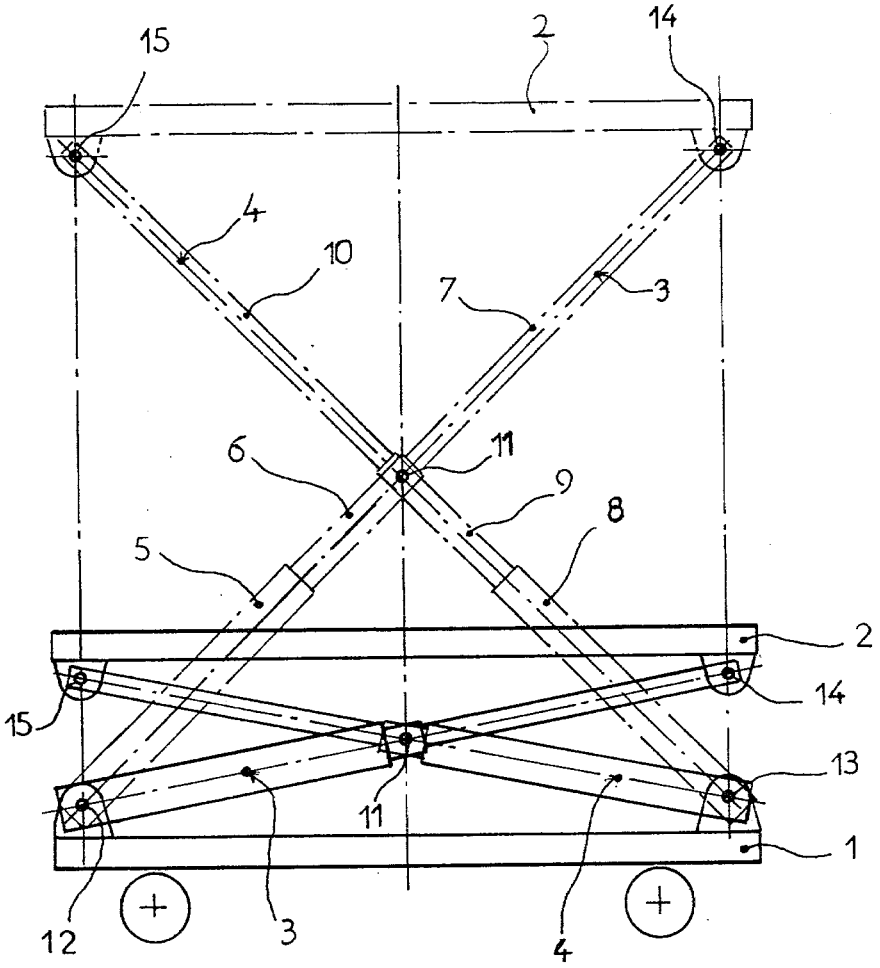
FIG. 1 represents diagrammatically the elevator platform according to the invention.

FIG. 1 shows a movable scissors elevator-platform constituted by a moving chassis 1, a horizontal elevation table 2, and a pair of elevator scissors 3 and 4, the table 2 being represented in low position and high position in the drawing.

According to the invention, the limbs 3 and 4 of the scissors elevator are each constituted by three telescopic elements (5, 6, 7) and (8, 9, 10), the last two elements (6, 7 and 9, 10) of which always extend by a length which is strictly the same for each.

Such telescopic devices are well known, for example in the field of telescopic cranes, and an example of these will be described hereinafter with reference to FIG. 3. The medial elements (6, 9) of each of the limbs (3, 4) of the pair of scissors are moreover connected together by a horizontal axis 11 located at the intersection of the planes formed by the axes (12, 13) and (14, 15) connecting the ends of the limbs (3, 4) respectively to the chassis 1 and the table 2, these connecting axes being at fixed positions. Lastly, the connecting axis 11 of the medial elements (6, 9) is at the same distance, on each of the limbs 3, 4, from the connecting axis (12 and 13 respectively) on the chassis 1 and from the connecting axis (14 and 15 respectively) on the elevator table 2.

The applicant has been able to ascertain that, with this arrangement:

(a) if the two telescopic limbs (3, 4) of the pair of scissors are simultaneously extended, the platform 2 rises vertically to a height which can be very considerable with respect to the dimensions of this; and (b) if one of the telescopic limbs is extended by a certain length, the other remaining fixed in length or being extended by a different length, the platform rises while remaining parallel to itself but being displaced longitudinally with respect to the chassis.

Figure 2:
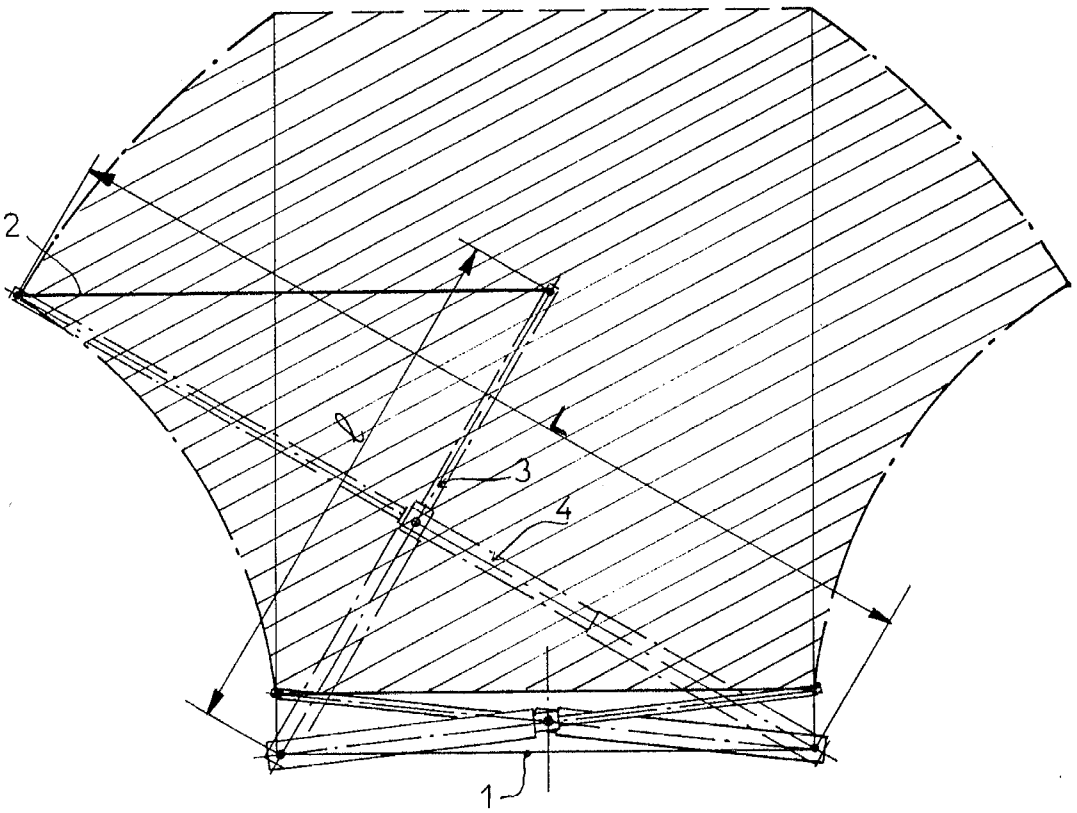
FIG. 2 shows the possibilities for maneuvering the elevator platform of FIG. 1.

This last behavior is illustrated in FIG. 2, which shows the maximal position of the platform 2, with the limb 3 presumed not to be telescoped, and therefore of minimal length l, and the limb 4 totally telescoped, of maximal length L. Moreover, the hatched region in FIG. 2 represents the area the platform 2 can occupy in space when all the possible lengths are given to the limbs 3 and 4.

Lastly, from a certain raised position of the platform, by acting independently on the extension of each limb of the pair of scissors so as to retract one of them while extending the other, it is possible to cause a longitudinal displacement of the platform 2 without changing its elevation.

The device according to the invention is obviously advantageous for use in raising a cabin containing passengers so as to give access to an airplane, for example. It is essential that this type of cabin remain approximately horizontal during maneuvering or at the very least parallel to the plane of rest of the chassis. This is certain to happen with the device of the invention, as has been shown with reference to FIG. 2. The device moreover permits longitudinal displacement of the raised cabin, allowing completion of adjustment of its distance from the airplane.

Figure 3:
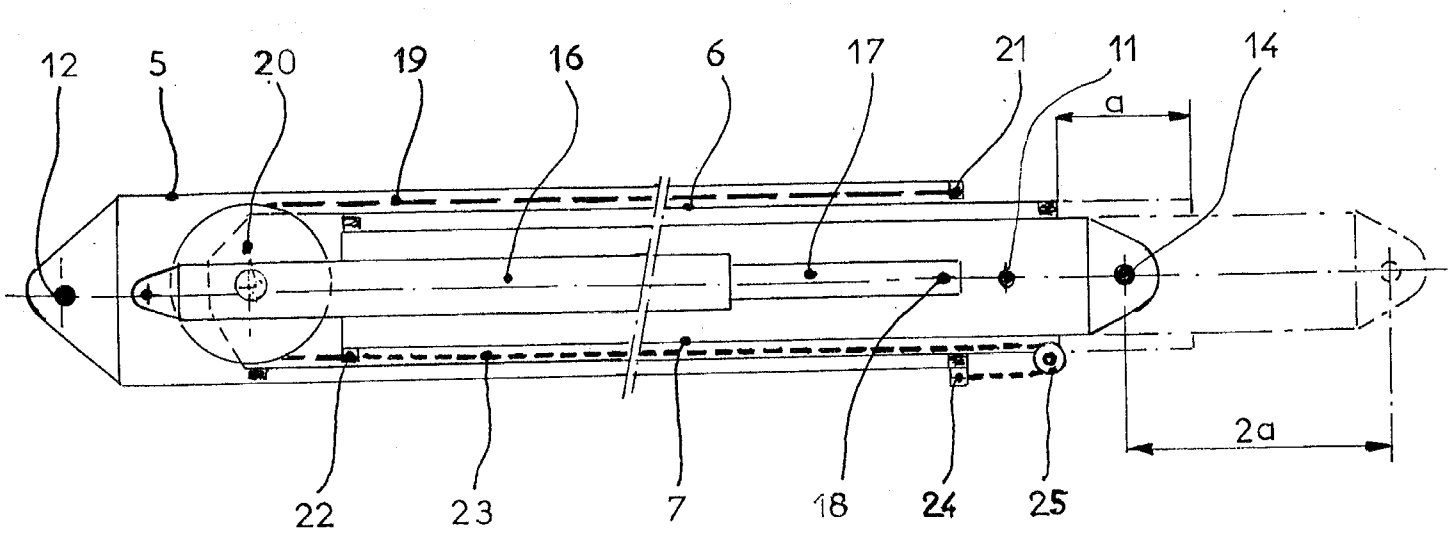
FIG. 3 represents diagrammatically an embodiment of the telescopic arm with which the device of the invention is to be equipped.

FIG. 3 shows, by way of guidance, a telescopic device with three elements of known type which is usable in the elevator of the invention. This device is constituted by three telescopic elements (5, 6, 7), the base element 5 of which is fixed and the other elements (6, 7)

sliding. The collapsed condition of the device has been represented in continuous line in the figure and a partially telescoped condition of this in chain dotted line.

The body of an actuator 16 is fixed to the base element 5 and the rod 17 of the actuator is also fixed by a pin 18 to the last element 7. A chain 19, passing around a pulley 20 adjacent the upstream part of the medial element 6, is stretched between a point 21 solid with the downstream part of the base element 5 and a point 22 solid with the upstream part of the last element 7. In a similar way, moreover, a chain 23 is stretched between the point 22 and a point 24 solid with the downstream part of the base element 5, passing around a pulley 25 solid with the downstream part of the medial element 6.

In operation, the rod 17 is caused to come out of the actuator 16 which, as seen in the drawing, extends the last element 7 by a length (*2a*) with respect to the base element 5. The chain 19 then simultaneously causes the medial element 6 to extend by a length (a) with respect to the fixed element 5. In this way, the two movable elements 6 and 7 extend by the same length (a), the first with respect to the base element 5 and the second with respect to the medial element 6. Similarly, when the element 7 is retracted by return of the rod 17 of the actuator 16, the chain 23 causes the simultaneous retraction of the element 6 by the same length. It is therefore clear that the telescopic device with three elements of FIG. 3 is such that the movable elements always have a strictly equal extension (a).

I claim:

1. A lift mechanism comprising (a) a mobile base;

(b) a support platform arranged above said base in substantially parallel orientation for movement with respect to said base;

(c) a pair of elevator scissors each having their opposite ends connected to said base and to said platform, respectively;

(d) each of said pair of scissors having three elements adapted to telescope within one another, said elements including (i) a base element fixedly mounted on said base and having an interior diameter sufficient to receive in their entirety the two other elements when in their fully retracted position;

(ii) a medial element slidable within said base element between retracted and extended positions; and (iii) an end element slidable within said medial element between retracted and extended positions;

(e) the medial elements of each of said pair of scissors being connected by a horizontal axle;

(f) means for coordinating the sliding movement of each of said medial and end elements of said pair of scissors, so that the movement of said medial element with respect to said base element is substantially equal to the movement of said end element with respect to said medial element;

(g) each of said pair of scissors being extendable and retractable independently of each other, whereby said platform is displaceable longitudinally with respect to said base while remaining substantially parallel thereto.

2. A lift mechanism according to claim 1, wherein said horizontal axle is located on each said pair of said scissors midway between the points of connection of said pair of scissors to said base and said support platform.

* * * * *